US010235922B2

(12) United States Patent
Hu

(10) Patent No.: US 10,235,922 B2
(45) Date of Patent: Mar. 19, 2019

(54) DISPLAY DEVICES AND METHODS OF ELIMINATING SPLIT SCREEN FOR DISPLAY DEVICES

(71) Applicant: Wuhan China Star Optoelectronics Technology Co., Ltd., Wuhan, Hubei (CN)

(72) Inventor: Lei Hu, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 230 days.

(21) Appl. No.: 15/328,592

(22) PCT Filed: Dec. 29, 2016

(86) PCT No.: PCT/CN2016/113256
§ 371 (c)(1),
(2) Date: Jan. 24, 2017

(87) PCT Pub. No.: WO2018/119948
PCT Pub. Date: Jul. 5, 2018

(65) Prior Publication Data

US 2018/0211581 A1 Jul. 26, 2018

(30) Foreign Application Priority Data

Dec. 27, 2016 (CN) ..... 2016 1 1226988

(51) Int. Cl.
*G09G 3/20* (2006.01)

(52) U.S. Cl.
CPC ..... *G09G 3/2007* (2013.01); *G09G 3/20* (2013.01); *G09G 2330/028* (2013.01)

(58) Field of Classification Search
CPC ... G09G 3/2007; G09G 3/20; G09G 2330/028
See application file for complete search history.

(56) References Cited

U.S. PATENT DOCUMENTS 6,429,841 B1 8/2002 Lee
2005/0128113 A1 1/2005 Kyung-Myun
2016/0189615 A1* 6/2016 Kwon ..... G09G 3/3258 345/214

FOREIGN PATENT DOCUMENTS

CN 101110187 A 1/2008
CN 101482664 A 7/2009
(Continued)

*Primary Examiner* — Abhishek Sarma
(74) *Attorney, Agent, or Firm* — Andrew C. Cheng

(57) ABSTRACT

A display device includes display panel component and a signal controller. The display panel components include a plurality of pixels arranged in a matrix, at least two data drivers, and data lines connecting to each of the data driver, and the pixels connect to the corresponding data line. The signal controller connects to the two data drivers to obtain two data voltages from data lines connecting to two adjacent data drivers when the pixels display mono-color images having the same grayscale. The signal controller adjusts gamma codes of the two adjacent data drivers in accordance with the obtained the data voltages until the data voltages of the data lines respectively connected to the two adjacent data drivers are the same. In view of the above, the screen split issue caused by adopting at least two data driver may be eliminated so as to enhance the display performance.

16 Claims, 2 Drawing Sheets

(56) References Cited

FOREIGN PATENT DOCUMENTS

| | | | |
|---|---|---|---|
| CN | 103117049 | A | 5/2013 |
| CN | 103903582 | A | 7/2014 |
| CN | 104751762 | A | 7/2015 |
| CN | 105741783 | A | 7/2016 |

* cited by examiner

DISPLAY DEVICES AND METHODS OF ELIMINATING SPLIT SCREEN FOR DISPLAY DEVICES

BACKGROUND OF THE INVENTION

1. Field of the Invention

The present disclosure relates to display technology, and more particularly to a display device and a method of eliminating split screen for display devices.

2. Discussion of the Related Art

In recent years, the user's pursuit of the display effect and the high-resolution of a display device has been increased day by day. The higher the resolution, the smaller the loss of the image displayed by the display device. The resolution of the display device is increased faster and faster. However, the speed of the chip (IC) development is not able to chase the resolution of the display device. Thus, with respect to such high-resolution display device, two or more driver chips have to be configured to drive the displays.

However, in the display device using two or more driving chips, the voltages outputted by the driving chips are different due to the differences generated during the manufacture process of the driving chips, such that the split screens issue happens.

SUMMARY

The present disclosure relates to a display device and a method of eliminating split screen.

In one aspect, a display device includes: display panel components and a signal controller; the display panel components includes a plurality of pixels arranged in a matrix, at least two data driver, and a plurality of data lines connecting to each of the data driver, and the pixels connect to the corresponding data line; the signal controller connects to the two data drivers to obtain two corresponding data voltages of the two data line respectively connecting to the two adjacent data drivers when the pixels display mono-color images having the same grayscale, and the signal controller adjusts gamma codes of the two adjacent data driver in accordance with the obtained the two data voltages until the data voltages of the data lines respectively connected to the two adjacent data drivers are the same.

Wherein the two data lines respectively connecting to the two adjacent data drivers are adjacent to each other.

Wherein the signal controller includes: a voltage detection transformation module detects data voltages on the two data lines respectively connected with the two data drivers when the pixels display the mono-color images having the same grayscale, and converts the detected data voltages into digital signals; a control module adjusts the gamma codes of the two adjacent data driver in accordance with the digital signals until the data voltage outputted from the two data lines respectively connected with the two adjacent data drivers are the same.

Wherein the signal controller further includes: a write module writes the adjusted gamma codes respectively to the two adjacent data drivers.

Wherein the voltage detection transformation module is a digital-to-analog converter (DAC).

In another aspect, a method of eliminating split screen for display devices includes: displaying mono-color images having the same grayscale by a plurality of pixels; obtaining two corresponding data voltages from the two data lines respectively connected with the two adjacent data drivers by a signal controller; adjusting gamma codes of the two adjacent data drivers in accordance with the a data voltage obtained by the signal controller until the data voltage outputted from the respective data lines connected with the two adjacent data drivers are the same.

Wherein the two data lines respectively connecting to the two adjacent data drivers are adjacent to each other.

Wherein the step of obtaining a data voltage on the two data lines respectively connected with the two data drivers by a signal controller further includes: obtaining the data voltages on the data lines respectively connected with the two data drivers by the signal controller; and converting the obtained data voltages into digital signals by the signal controller.

Wherein the step of adjusting gamma codes of the two adjacent data drivers in accordance with the data voltage obtained by the signal controller further includes: comparing the digital signals by the signal controller; adjusting the gamma codes of the two adjacent data driver in accordance with a comparison result by the signal controller.

Wherein the step of adjusting gamma codes of the two adjacent data drivers in accordance with the data voltage obtained by the signal controller until the data voltage outputted from the respective data lines connected with the two adjacent data drivers are the same further includes: writing the adjusted gamma codes to the two adjacent data drivers by the signal controller.

In view of the above, the screen split issue caused by adopting at least two data driver may be eliminated so as to enhance the display performance.

BRIEF DESCRIPTION OF THE DRAWINGS

Embodiments of the invention will now be described more fully hereinafter with reference to the accompanying drawings, in which embodiments of the invention are shown.

DETAILED DESCRIPTION OF THE EMBODIMENTS

Figure 1:
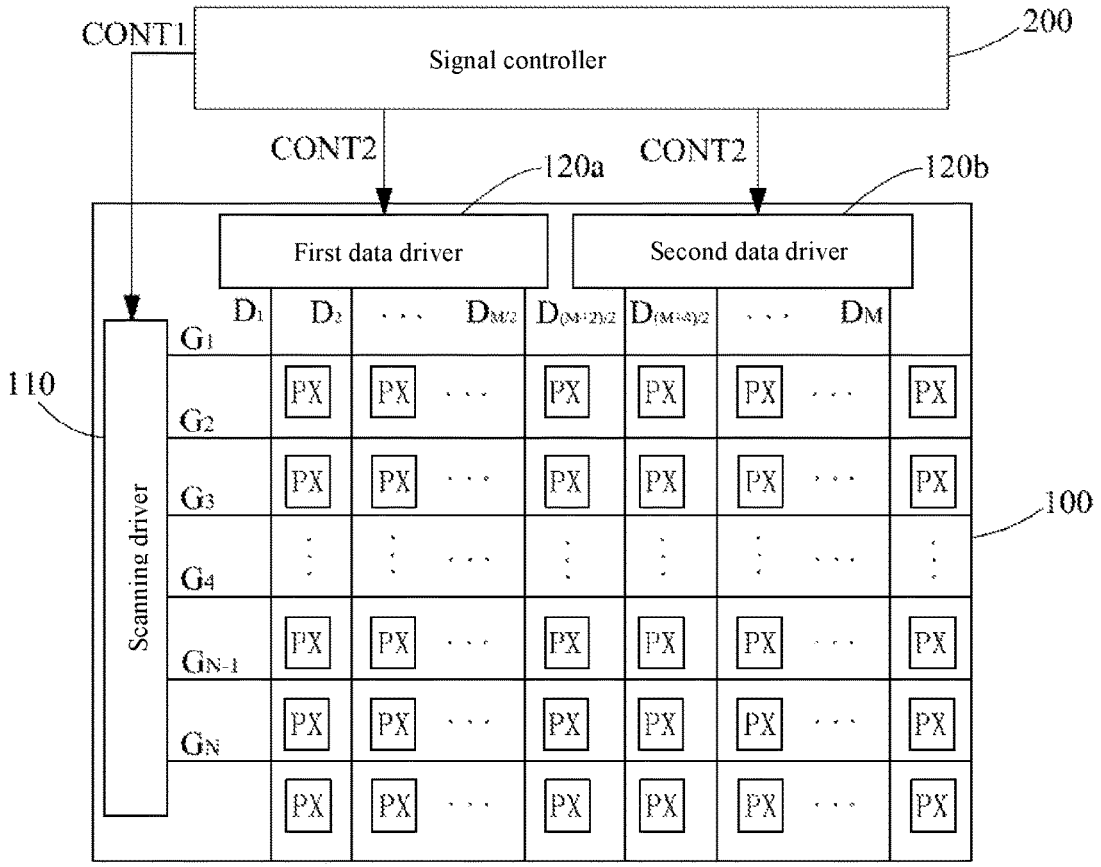
FIG. 1 is a schematic view of the display device in accordance with one embodiment.

Various example embodiments will now be described more fully with reference to the accompanying drawings in which some example embodiments are shown. In the drawings, the thicknesses of layers and regions may be exaggerated for clarity. In the following description, in order to avoid the known structure and/or function unnecessary detailed description of the concept of the invention result in confusion, well-known structures may be omitted and/or functions described in unnecessary detail.

FIG. 1 is a schematic view of the display device in accordance with one embodiment.

Referring to FIG. 1, the display device includes a display panel component 100 and a signal controller 200.

The display panel component 100 includes a plurality of pixels (PX) arranged in a matrix, N number of scanning lines ($G_1$ to $G_N$), M number of data lines ($D_1$ to $D_M$), a scanning driver 110, a first data driver 120*a*, and a second data driver

120*b*. In one embodiment, only two data drivers are shown, but the present disclosure is not limited thereto. That is, for a display device having a higher resolution, two or more data drivers may be configured.

Each of the pixels (PX) connects to corresponding scanning line and data line. Each of the pixels (PX) includes a switch component (not shown) connecting to the corresponding scanning line and the corresponding data line, a lighting unit (not shown) connecting to the switch component. In the embodiment, the switch component may be a thin film transistor (TFT), but the present disclosure is not limited thereto. The lighting unit may be a liquid crystal lighting unit or an organic lighting unit.

The scanning driver 110 connects to scanning lines ($G_1$ to $G_N$) and applies scanning signals to the scanning lines ($G_1$ to $G_N$), wherein the scanning signals include high-level signals and low-level signals.

The first data driver 120*a* connects to the data lines ($D_1$ to $D_{M/2}$) and applies a data voltage to the data lines ($D_1$ to $D_{M/2}$), the second data driver 120*b* connects to the data lines ($D_{(M+2)/2}$ to $D_M$) and applies the data voltage to the data lines ($D_{(M+2)/2}$ to $D_M$).

In one embodiment, the scanning driver 110, the first data driver 120*a*, and the second data driver 120*b* are integrated within the display panel component 100. Alternatively, the scanning driver 110, the first data driver 120*a*, and the second data driver 120*b* are printed on a flexible printing thin film (not shown), and are adhered to the display panel component 100 (The display panel component 100 does not include the scanning driver 110, the first data driver 120*a*, and the second data driver 120*b* at this moment).

The signal controller 200 controls operations of the scanning driver 110, the first data driver 120*a*, and the second data driver 120*b*.

The signal controller 200 generates the scanning control signals (CONT1) and data control signals (CONT2). The signal controller 200 transmits the scanning control signals (CONT1) to the scanning driver 110, and transmits the data control signals (CONT2) respectively to the first data driver 120*a* and the second data driver 120*b*.

In response to the data control signals (CONT2), the first data driver 120*a* and the second data driver 120*b* generates the data voltage in accordance with gamma codes respectively stored and applies the data voltage to the data lines ($D_1$ to $D_{M/2}$) and the data lines ($D_{(M+2)/2}$ to $D_M$).

In response to the scanning control signals (CONT1), the scanning driver 110 applies high-level scanning signals to the scanning lines ($G_1$ to $G_N$) to turn on the switch component connected with the scanning lines ($G_1$ to $G_N$). Afterward, the data voltage applied to the data lines ($D_1$ to $D_{M/2}$) and data lines ($D_{(M+2)/2}$ to $D_M$) is transmitted to each of the pixels (PX) via the turned-on switch component.

Due to the difference generated in the manufacturing process, the data voltage outputted by the first data driver 120*a* and the second data driver 120*b* are different such that the split screen issue may happen, in particular, the split screen issue is the most obvious one with respect to the data line ($D_{M/2}$) connected with the first data driver 120*a* and the data line ($D_{(M+2)/2}$) connected with the second data driver 120*b*.

To eliminate split screen, that is, the pixels (PX) display mono-color images having the same grayscale, the signal controller 200 obtains the data voltage of the data line ($D_i$) connected with the first data driver 120*a* and the data line ($D_j$) connected with the second data driver 120*b*. In addition, the signal controller 200 adjusts the gamma code of the first data driver 120*a* and the second data driver 120*b* in accordance with the data voltage until the data voltage outputted from the first data driver 120*a* to the data line ($D_i$) is the same with the data voltage outputted from the second data driver 120*b* to the data line ($D_j$), wherein $1 \le i < M/2$, and $(M+2)/2 \le j \le M$.

Preferably, as the data line ($D_{M/2}$) of the first data driver 120*a* is adjacent to the data line ($D_{(M+2)/2}$) of the second data driver 120*b*, the split screen issue is the most obvious one with respect to the data line ($D_{M/2}$) connected with the first data driver 120*a* and the data line ($D_{(M+2)/2}$) connected with the second data driver 120*b*.

To effectively eliminate the above screen split issue, the pixels (PX) are controlled to display mono-color images having the same grayscale. The signal controller 200 obtains the data voltage of the data line ($D_{M/2}$) connected with the first data driver 120*a* and of the data line ($D_{(M+2)/2}$) connected with the second data driver 120*b*. In addition, the signal controller 200 adjusts the gamma code of the first data driver 120*a* and the second data driver 120*b* in accordance with the obtained data voltage until the data voltage outputted to the data line ($D_{M\ 2}$) from the first data driver 120*a* is the same with the data voltage outputted to the data line ($D_{(M+2)/2}$) from the second data driver 120*b*.

Further, the signal controller 200 writes the adjusted gamma code to the first data driver 120*a* and the second data driver 120*b*.

Figure 2:
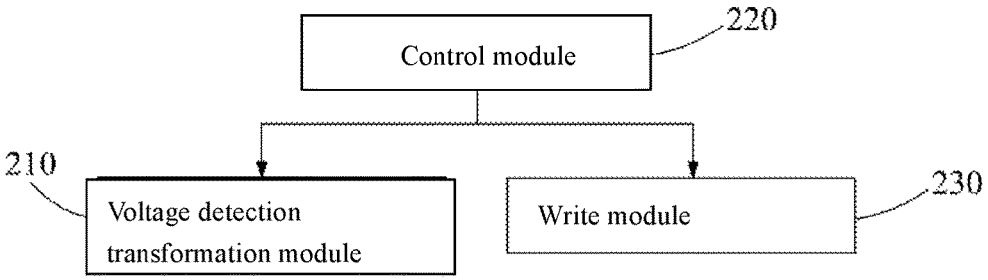
FIG. 2 is a block diagram of the signal controller in accordance with one embodiment.

FIG. 2 is a block diagram of the signal controller in accordance with one embodiment.

The signal controller 200 includes a voltage detection transformation module 210, a control module 220, an a write module 230.

Preferably, the voltage detection transformation module 210 may be a digital-to-analog converter (DAC), but the present disclosure is not limited thereto. When the pixels (PX) display the mono-color images having the same grayscale, the voltage detection transformation module 210 detects a first data voltage on the data line ($D_i$) connected with the first data driver 120*a* and detects a second data voltage on the data line ($D_j$) connected with the second data driver 120*b*. The voltage detection transformation module 210 converts the first data voltage and the second data voltage into first digital signals and second digital signals.

The voltage detection transformation module 210 transmits the first digital signals and the second digital signals to the control module 220. The control module 220 compares the first digital signals with the second digital signals, and adjusts the gamma code of the first data driver 120*a* and the second data driver 120*b* in accordance with the comparison result until the data voltage on the data line ($D_i$) outputted from the first data driver 120*a* is the same with the data voltage on the data line ($D_j$) outputted from the second data driver 120*b*. The control module 220 adjusts the gamma code of the second data driver 120*b* by taking the gamma code of the first data driver 120*a* as a reference, or the control module 220 adjusts the gamma code of the first data driver 120*a* by taking the gamma code of the second data driver 120*b* as the reference. Alternatively, the control module 220 adjusts the gamma code of the first data driver 120*a* and the second data driver 120*b* respectively in accordance with a predetermined gamma code.

The control module 220 writes the adjusted gamma code to the write module 230, and the write module 230 writes the adjusted gamma code to the first data driver 120*a* and the second data driver 120*b*.

Figure 3:
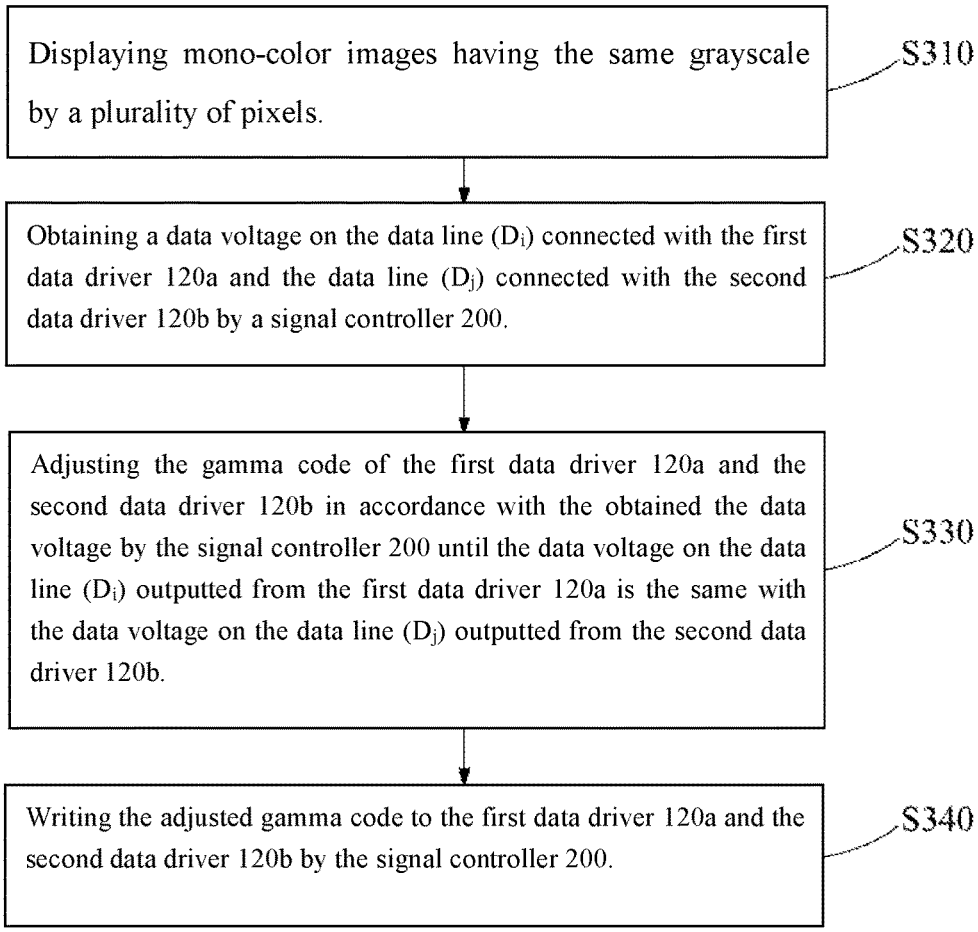
FIG. 3 is a flowchart illustrating the method of eliminating split screen for display devices in accordance with one embodiment.

FIG. 3 is a flowchart illustrating the method of eliminating split screen for display devices in accordance with one embodiment.

Referring to FIGS. 1 and 3, the method of eliminating split screen for display devices includes the following steps.

In step S310, displaying mono-color images having the same grayscale at the same time by a plurality of pixels (PX).

In step S320: obtaining a data voltage on the data line ($D_i$) connected with the first data driver 120*a* and the data line ($D_j$) connected with the second data driver 120*b* by a signal controller 200.

Referring to FIG. 2, the step S320 further includes: detecting a first data voltage on the data line ($D_i$) connected with the first data driver 120*a* and detecting a second data voltage on the data line ($D_j$) connected with the second data driver 120*b;* converting the first data voltage and the second data voltage respectively into first digital signals and second digital signals, i.e., the data voltage, by the voltage detection transformation module 210 of the signal controller 200.

In step S330, adjusting the gamma code of the first data driver 120*a* and the second data driver 120*b* in accordance with the obtained the data voltage until the data voltage on the data line ($D_i$) outputted from the first data driver 120*a* is the same with the data voltage on the data line ($D_j$) outputted from the second data driver 120*b*.

Also referring to FIG. 2, the step S330 further includes: compares the first digital signals with the second digital signals by the control module 220 of the signal controller 200; adjusting the gamma code of the first data driver 120*a* and the second data driver 120*b* by the control module 220 of the signal controller 200 in accordance with a comparison result until the data voltage on the data line ($D_i$) outputted from the first data driver 120*a* is the same with the data voltage on the data line ($D_j$) outputted from the second data driver 120*b*.

The control module 220 adjusts the gamma code of the second data driver 120*b* by taking the gamma code of the first data driver 120*a* as a reference, or the control module 220 adjusts the gamma code of the first data driver 120*a* by taking the gamma code of the second data driver 120*b* as the reference. Alternatively, the control module 220 adjusts the gamma code of the first data driver 120*a* and the second data driver 120*b* respectively in accordance with a predetermined gamma code.

In step S340, writing the adjusted gamma code to the to the first data driver 120*a* and the second data driver 120*b* by the signal controller 200.

Referring to FIG. 2, the step S340 further includes: the write module 230 of the signal controller 200 writes the adjusted gamma code to the first data driver 120*a* and the second data driver 120*b*.

In addition, the above-described method of the claimed invention may be implemented as a computer-readable recording medium of computer code. Persons skilled in the art are capable of implementing the computer codes according to the methods described above, and the method is performed when the computer codes are executed by the computer.

In addition, the components or modules of the display devices may be implemented by hardware component. Persons skilled in the art are capable of implementing the component or modules by a field programmable gate array (FPGA) or application specific integrated circuit (ASIC) to achieve the respective units.

In view of the above, the screen split issue caused by adopting at least two data driver may be eliminated so as to enhance the display performance.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A display device, comprising:

display panel components and a signal controller;

wherein the display panel components comprises a plurality of pixels arranged in a matrix, at least two data drivers, and a plurality of data lines connecting to each of the data driver, and the pixels connect to the corresponding data line;

the signal controller connects to the two data drivers to obtain two corresponding data voltages from the two data lines respectively connecting to the two adjacent data drivers when the pixels display mono-color images having the same grayscale, and the signal controller adjusts gamma codes of the two adjacent data drivers in accordance with the obtained two data voltages until the data voltages of the data lines respectively connected to the two data drivers are the same.

2. The display device as claimed in claim 1, wherein the two data lines respectively connecting to the two adjacent data drivers are adjacent to each other.

3. The display device as claimed in claim 1, wherein the signal controller comprises:

a voltage detection transformation module detects data voltages on the two data lines respectively connected with the two data drivers when the pixels display the mono-color images having the same grayscale, and converts the detected data voltages into digital signals;

a control module adjusts the gamma codes of the two adjacent data driver in accordance with the digital signals until the data voltage outputted from the two data lines respectively connected with the two adjacent data drivers are the same.

4. The display device as claimed in claim 2, wherein the signal controller comprises:

a voltage detection transformation module detects data voltages on the two data lines respectively connected with the two data drivers when the pixels display the mono-color images having the same grayscale, and converts the detected data voltages into digital signals;

a control module adjusts the gamma codes of the two adjacent data driver in accordance with the digital signals until the data voltage outputted from the two data lines respectively connected with the two adjacent data drivers are the same.

5. The display device as claimed in claim 3, wherein the signal controller further comprises:

a write module writes the adjusted gamma codes respectively to the two adjacent data drivers.

6. The display device as claimed in claim 4, wherein the signal controller further comprises:

a write module writes the adjusted gamma codes respectively to the two adjacent data drivers.

7. The display device as claimed in claim 3, wherein the voltage detection transformation module is a digital-to-analog converter (DAC).

8. The display device as claimed in claim 4, wherein the voltage detection transformation module is a digital-to-analog converter (DAC).

9. A method of eliminating split screen for display devices, comprising:

displaying mono-color images having the same grayscale by a plurality of pixels;

obtaining two corresponding data voltages from the two data lines respectively connected with the two data drivers by a signal controller;

adjusting gamma codes of the two data drivers in accordance with the two data voltage obtained by the signal controller until the data voltages outputted from the respective data lines connected with the two data drivers are the same.

10. The method as claimed in claim 9, wherein the two data lines respectively connecting to the two adjacent data drivers are adjacent to each other.

11. The method as claimed in claim 9, wherein the step of obtaining a data voltage on the two data lines respectively connected with the two data drivers by a signal controller further comprises:

obtaining the data voltages on the data lines respectively connected with the two data drivers by the signal controller; and converting the obtained data voltages into digital signals by the signal controller.

12. The method as claimed in claim 10, wherein the step of obtaining a data voltage on the two data lines respectively connected with the two data drivers by a signal controller further comprises:

obtaining the data voltages on the data lines respectively connected with the two data drivers by the signal controller; and converting the obtained data voltages into digital signals by the signal controller.

13. The method as claimed in claim 11, wherein the step of adjusting gamma codes of the two adjacent data drivers in accordance with the data voltage obtained by the signal controller further comprises:

comparing the digital signals by the signal controller;

adjusting the gamma codes of the two adjacent data driver in accordance with a comparison result by the signal controller.

14. The method as claimed in claim 12, wherein the step of adjusting gamma codes of the two adjacent data drivers in accordance with the data voltage obtained by the signal controller further comprises:

comparing the digital signals by the signal controller;

adjusting the gamma codes of the two adjacent data driver in accordance with a comparison result by the signal controller.

15. The method as claimed in claim 9, wherein the step of adjusting gamma codes of the two adjacent data drivers in accordance with the data voltage obtained by the signal controller until the data voltage outputted from the respective data lines connected with the two adjacent data drivers are the same further comprises:

writing the adjusted gamma codes to the two adjacent data drivers by the signal controller.

16. The method as claimed in claim 10, wherein the step of adjusting gamma codes of the two adjacent data drivers in accordance with the data voltage obtained by the signal controller until the data voltage outputted from the respective data lines connected with the two adjacent data drivers are the same further comprises:

writing the adjusted gamma codes to the two adjacent data drivers by the signal controller.

* * * * *